US005269668A

United States Patent [19]

Lew et al.

[11] Patent Number: 5,269,668

[45] Date of Patent: Dec. 14, 1993

[54] FOLDING-UNFOLDING ROTATING FLAP METER-MOTOR-PUMP

[76] Inventors: Hyok S. Lew; Yon K. Lew; Hyon S. Lew, all of 7890 Oak St., Arvada, Colo. 80005

[21] Appl. No.: 8,598

[22] Filed: Jan. 25, 1993

[51] Int. Cl.[5] ..... F01C 1/00; F03C 2/00

[52] U.S. Cl. ..... 418/241; 418/234; 73/253

[58] Field of Search ..... 418/35, 137, 234, 241, 418/253, 259; 73/253, 259, 260

[56] References Cited

U.S. PATENT DOCUMENTS 3,797,975 3/1974 Keller ..... 418/241

3,954,357 5/1976 Ziehl ..... 418/137

FOREIGN PATENT DOCUMENTS 0451422 10/1927 Fed. Rep. of Germany ..... 418/234

*Primary Examiner*—Richard A. Bertsch

*Assistant Examiner*—Charles G. Freay

[57] ABSTRACT

A positive displacement fluid handling apparatus comprises a body including a circular cylindrical cavity with two closed ends and two port openings respectively open to the two opposite halves of the circular cylindrical cavity; a flap assembly including a plurality of flaps disposed in the circular cylindrical cavity in a radiating pattern and supported by the body rotatably about a first axis of rotation concentric to the circular cylindrical cavity in an independently rotatable arrangement, wherein the outer radial edges of the flaps slide on the circular cylindrical wall of the circular cylindrical cavity and the inner radial edges of the flaps are assembled in a radially converging leak-proof assembly; and a flap spacer assembly including a plurality of rollers or spacers disposed on a circular cylindrical surface enclosing the first axis of rotation and coaxial to a second axis of rotation eccentric to the circular cylindrical cavity and supported by the body rotatably about the second axis of rotation, wherein the individual flaps engage and extend respectively through every other spacings between the rollers or spacers, while the remaining spacings between the rollers or spacers not engaged by any flaps provides vent openings for the fluid to move in and out of the cylindrical boundary of the flap spacer assembly.

19 Claims, 3 Drawing Sheets

FOLDING-UNFOLDING ROTATING FLAP METER-MOTOR-PUMP

BACKGROUND OF INVENTION

One of the conventional fluid handling apparatus known by the name of "flapping vane compressor" or "eccentric roller compressor" has a circular cylindrical cavity with two port openings respectively open to the two opposite halves thereof, a plurality of flaps or vanes disposed in the circular cylindrical cavity about the central axis thereof in a radially extending pattern wherein the individual flap or vane is independently rotatable about an axis of rotation concentric to the circular cylindrical cavity, and a plurality of rollers or spacers assembled into a circular cylindrical shell structure resembling a squirrel cage construction, that is disposed eccentrically within the circular cylindrical cavity rotatably about an axis of rotation eccentric to the circular cylindrical cavity, wherein each of the plurality of flaps engages and extends through each of the plurality of gaps between the plurality of rollers or spacers in a close tolerance relationship. Without any exceptions, all of the different versions of the flapping vane compressor or eccentric roller compressor adopt a design that employs sealing between the individual flap or vane and the individual gaps between the rollers or spacers in the sliding engagement therebetween. As a consequence, in such conventional fluid handling apparatus the fluid media flowing therethrough is confined within an annular region between the circular cylindrical boundary of the roller or spacer assembly and the circular cylindrical wall of the circular cylindrical cavity, wherein the friction arising from the sealing engagement between the individual flap and the individual gap between the rollers or spacers hampers the operating efficiency and shortens the life span of the apparatus. As the volume of the sealed space between two adjacent flaps or vanes, that is occupied by the fluid media moving through the aforementioned conventional fluid handling apparatus, experiences a compression or expansion during rotation of the flaps or vanes, such a conventional apparatus can be applied to the handling of a compressible gaseous media only, and cannot be used to handle any incompressible liquid media. Contrary to the conventional wisdom teaching the construction and operating principles of the conventional flapping vane or eccentric roller compressor, the inventors of the present invention have discovered that the sealing universally employed in those conventional apparatus is a redundant and parasitic feature and consequently, can be omitted in a new fluid handling apparatus of the present invention, that operates much more efficiently for much longer life span compared to those conventional apparatus because of the drastically reduced level of friction resulting from the elimination of the sealing between the flaps or vanes and the rollers or spacers. Most importantly, the apparatus of the present invention can be used to handle the compressible gaseous media as well as the incompressible liquid media.

BRIEF SUMMARY OF INVENTION

The primary object of the present invention is to provide a positive displacement flowmeter or fluid motor or pump, that comprises a circular cylindrical cavity included in the body of the apparatus that has two port openings respectively open to the two opposite halves of the circular cylindrical cavity, which circular cylindrical cavity houses a flap assembly including a plurality of flaps disposed about a first axis of rotation concentric to the circular cylindrical cavity in a radially extending pattern, wherein the individual flap is supported by the apparatus body rotatably about the first axis of rotation and the radial edge of the individual flap slides on the circular cylindrical wall of the circular cylindrical cavity during rotation of the flap, and a flap spacer assembly including a plurality of rollers or spacers assembled into a circular cylindrical shell structure resembling a squirrel cage construction, that is supported by the apparatus body rotatably about a second axis of rotation eccentric to the circular cylindrical cavity, wherein each of the plurality of flaps engages and extends through each of the plurality of gaps between the rollers or spacers in a free-sliding clearance relationship, and the flap spacer assembly includes a plurality of vent openings disposed through the circular cylindrical boundary thereof whereby the fluid media is allowed to move freely in and out of the circular cylindrical boundary of the flap spacer assembly. In the present invention, the inner radial extremities of the flaps are assembled about the first axis of rotation in a sealing relationship that prevents or limits leak of the fluid media from an apex region between an adjacent pair of flaps to an apex region between another adjacent pair of flaps through the crevices between the inner radial extremities of the flaps assembled into a converging pattern.

Another object is to provide a modified version of the apparatus described in the above-mentioned primary object of the present invention, wherein the flap spacer assembly with the plurality of gaps between the rollers or spacers respectively engaged by the plurality of flaps does not have any separate vent openings through the circular cylindrical boundary thereof, as the width of the individual gap between each adjacent pair of rollers or spacers is much greater than the thickness of the individual flap extending therethrough and consequently, the space therebetween provides a sufficient vent opening for the fluid media to move in and out of the circular cylindrical boundary of the flap spacer assembly.

These and other objects of the present invention will become clear as the description thereof progresses.

BRIEF DESCRIPTION OF FIGURES

The present invention may be described with a greater clarity and specificity by referring to the following figures.

DESCRIPTION OF ILLUSTRATED EMBODIMENTS

Figure 1:
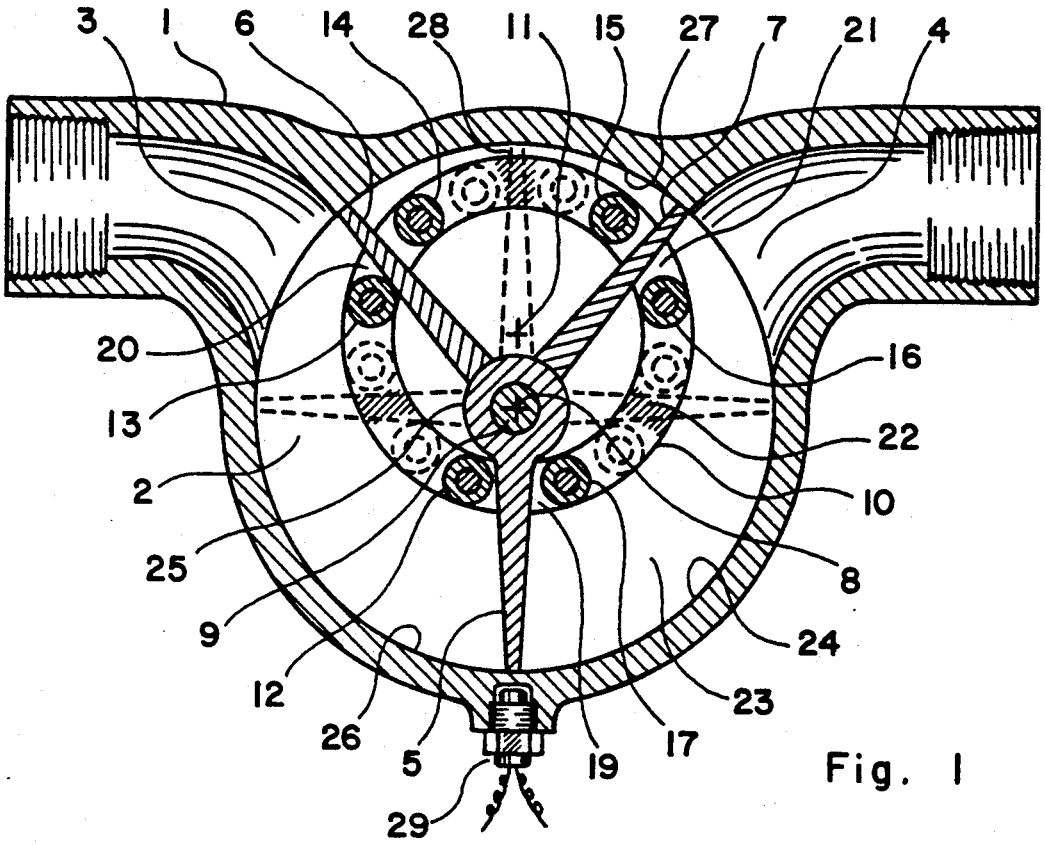
FIG. 1 illustrates a cross section of an embodiment of the present invention comprising three flaps.
Figure 4:
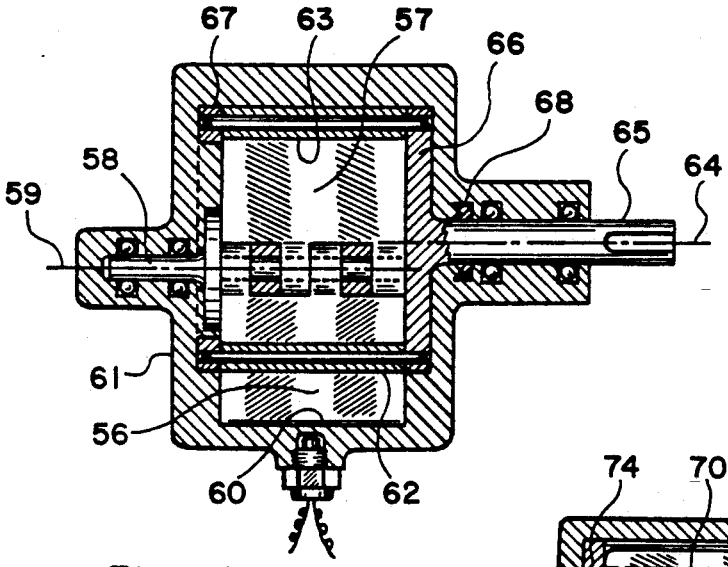
FIG. 4 illustrates a cross section of an embodiment of the combination of the flap assembly and the flap spacer assembly.
Figure 5:
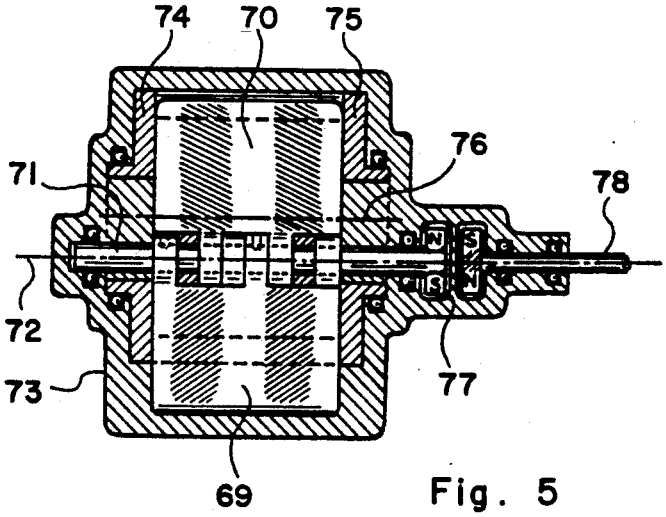
FIG. 5 illustrates a cross section of another embodiment of the combination of the flap assembly and the flap spacer assembly.
Figure 6:
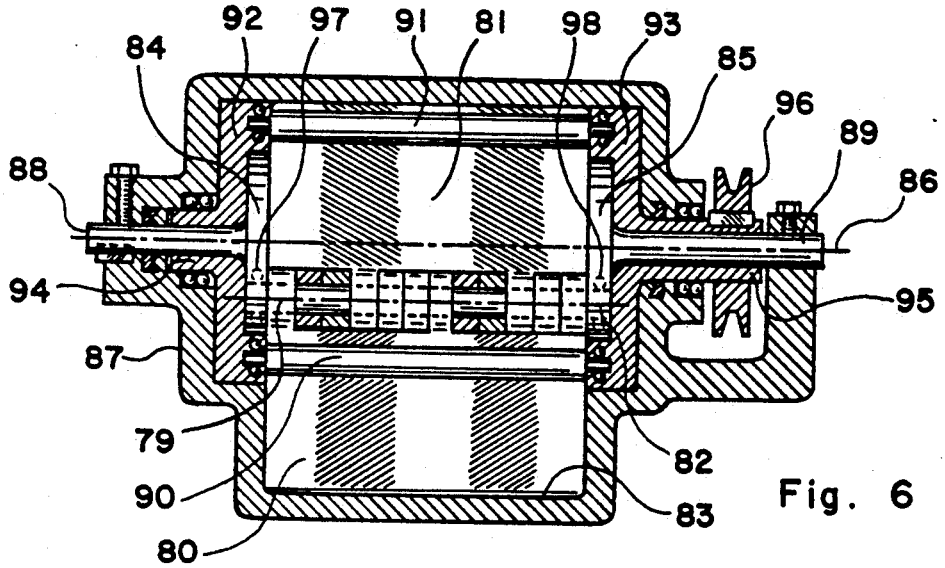
FIG. 6 illustrates a cross section of a further embodiment of the combination of the flap assembly and the flap spacer assembly.

In FIG. 1 there is illustrated a cross section of an embodiment of the present invention employing three flaps, that is the minimum number of flaps which must be included in the present invention. The body 1 of the apparatus includes a circular cylindrical cavity 2 with two closed end walls, that has two port openings 3 and 4 respectively open to the two opposite halves of the circular cylindrical cavity 2. The three flaps 5, 6 and 7 are disposed within the circular cylindrical cavity 2 in a radially extending pattern from the first axis of rotation 8 concentric to the circular cylindrical cavity 2, wherein the three flaps 5, 6 and 7 are supported by a shaft 9 with central axis coinciding with the first axis of rotation 8 in a relationship allowing each individual flap to rotate independently about the first axis of rotation 8, and the radial edge of each individual flap slides on the circular cylindrical wall of the circular cylindrical cavity 2 during rotation thereof about the first axis of rotation 8. A flap spacer assembly 10 disposed eccentrically within the circular cylindrical cavity 2 rotatably about a second axis of rotation 11 includes six rollers or spacers 12, 13, 14, 15, 16 and 17 distributed following a circular cylindrical surface coaxial to the second axis of rotation 11, which rollers or spacers are supported by one or more end plates or end rings 18 disposed coaxially to the second axis of rotation 11 and supported by the apparatus body rotatably about the second axis of rotation 11. The six rollers or spacers 12, 13, 14, 15, 16 and 17 are grouped into three pairs, each of which three pairs provides two opposite edges of each of three axial openings 19, 20 and 21 uniformly distributed following the circular cylindrical surface coaxial to the second axis of rotation 11. The individual flap engages and extends through the individual axial opening in a free-sliding clearance relationship. As shown in FIGS. 4, 5 and 6, the inside surfaces 22 of the end plates or end rings 18 are disposed flush to the end walls 23 of the circular cylindrical cavity 2. The two opposite end edges of the individual flap slide respectively on the two opposite end walls of the circular cylindrical cavity 2, while the outer radial edge of the individual flap slides on the circular cylindrical wall 24 of the circular cylindrical cavity 2. The hubs 25 of the flaps 5, 6 and 7 are assembled together and rotatably mounted on the shaft 9 in an arrangement similar to the piano-hinge, which arrangement provides sealing against leak of the fluid media from an apex region between one adjacent pair of flaps to an apex region between another adjacent pair of flaps through the crevices between the inner radial edges of the flaps assembled into the assembly resembling the piano-hinge. Therefore, the fluid media is not allowed to flow across the individual flap from one compartment between one adjacent pair of flaps to another compartment between other adjacent pair of flaps unless the radial edge of the flap is positioned in one of the two port openings 3 and 4. It should be noticed that the fluid media moving through the apparatus is allowed to move freely in and out of the circular cylindrical boundary of the flap spacer assembly 10 as the vent openings between the three pairs of the rollers or spacers 12, 13, 14, 15, 16 and 17 respectively providing the three axial openings 19, 20 and 21 provide three unobstructed passages for the fluid media to move across the circular cylindrical boundary of the flap spacer assembly 10, which feature constitutes the unique and patentable structural aspect of the present invention yielding a very important advantage in the operation of the apparatus. The positions of three flaps shown in broken lines represent the position of the flaps 5, 6 and 7, when the flap spacer assembly 10 is rotated over 60 degrees from the position thereof shown in solid lines. In order to be a true positive displacement apparatus, the two port openings 3 and 4 must be separated from one another by at least one continuous solid barrier diametrically extending across the circular cross section of the circular cylindrical cavity 2 at all instants. It is readily recognized that the aforementioned condition for the positive displacement apparatus becomes satisfied, when the two port openings 3 and 4 are separated from one another on one circumferential side by an unbroken portion 26 of the circular cylindrical wall 24 covering an angle about the central axis of the circular cylindrical cavity 2, that is at least substantially equal to the maximum angle between two adjacent flaps taking place during rotation of the flap assembly about the first axis of rotation 8, and on the other circumferential side by another unbroken portion 27 of the circular cylindrical wall 24 covering an angle about the central axis of the circular cylindrical cavity 2, that is at least substantially equal to the minimum angle between two adjacent flaps taking place during rotation of the flap assembly about the first axis of rotation 8. It should be understood that, when the above-mentioned two angular separations about the central axis of the circular cylindrical cavity 2 between the two port openings 3 and 4 are respectively set substantially equal to the maximum and minimum angles between two adjacent flaps occurring during rotation of the flap assembly, the volume of the sealed-off space surrounded by any two adjacent flaps and one of the two unbroken portions 26 and 27 of the circular cylindrical wall 24 does not experience any expansion or compression. Therefore, an embodiment of the present invention satisfying the above-mentioned condition can be applied to handle all types of fluid media including the compressible gases and incompressible liquids. When the above-mentioned two angular separations between the two port openings 3 and 4 are respectively set substantially greater than the maximum and minimum angles between two adjacent flaps occurring during rotation of the flap assembly, the volume of sealed-off space surrounded by any two adjacent flaps and one of the two unbroken portions 26 and 27 of the circular cylindrical wall 24 experiences an expansion in the first half of the circular cylindrical cavity 2 adjacent to one of the two port openings 3 and 4, and a compression in the second half of the circular cylindrical cavity adjacent to the other of the two port openings 3 and 4, and consequently, such an embodiment of the present invention must be applied only to the handling of the compressible gaseous media. The outer circumference of the flap spacer assembly 10 may be spaced inwardly from the unbroken portion 27 of the circular cylindrical wall 24 as exemplified by the gap 28 as shown in the particular illustrative embodiment, or may be tangential to the circular cylindrical wall 24 as exemplified by the embodiment shown in FIG. 3. It has now become clear that, in the embodiment shown in FIG. 1 as well as those illustrated in FIGS. 2, 3 and 7, the fluid media cannot flow through the apparatus without rotating the flap assembly and vice versa. Therefore, the flowing motion of the fluid media moving through the apparatus and the rotating motion of the flap assembly is positively coupled to one another in the present invention, and consequently, the present invention can be used as a flowmeter or fluid motor or pump, or compressor. A motion sensor 29 detecting the flaps passing thereby provides the information on the volume flow rate of the fluid media moving through the apparatus.

Figure 2:
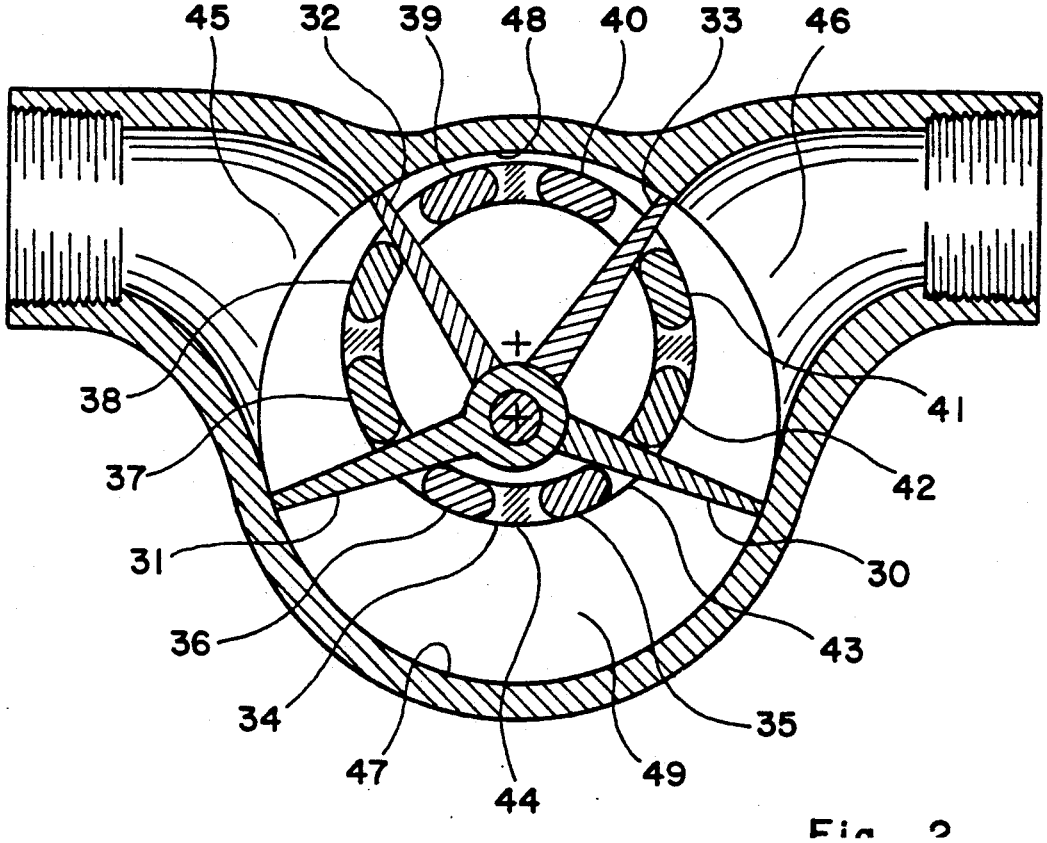
FIG. 2 illustrates a cross section of another embodiment employing four flaps.

In FIG. 2 there is illustrated a cross section of another embodiment of the present invention employing four flaps 30, 31, 32 and 33. In this embodiment, the flap spacer assembly 34 comprises a plurality of fixed spacers 35, 36, 37, 38, 39, 40, 41 and 42 providing a plurality of axial openings 43 respectively engaged by the plurality of flaps, and a plurality of vent openings 44 disposed between the axial openings 43 in an alternating manner. It should be noticed again that the two port openings 45 and 46 are separated by the two unbroken portions 47 and 48 of the circular cylindrical wall of the circular cylindrical cavity 49 in the same manner described in conjunction with FIG. 1.

Figure 3:
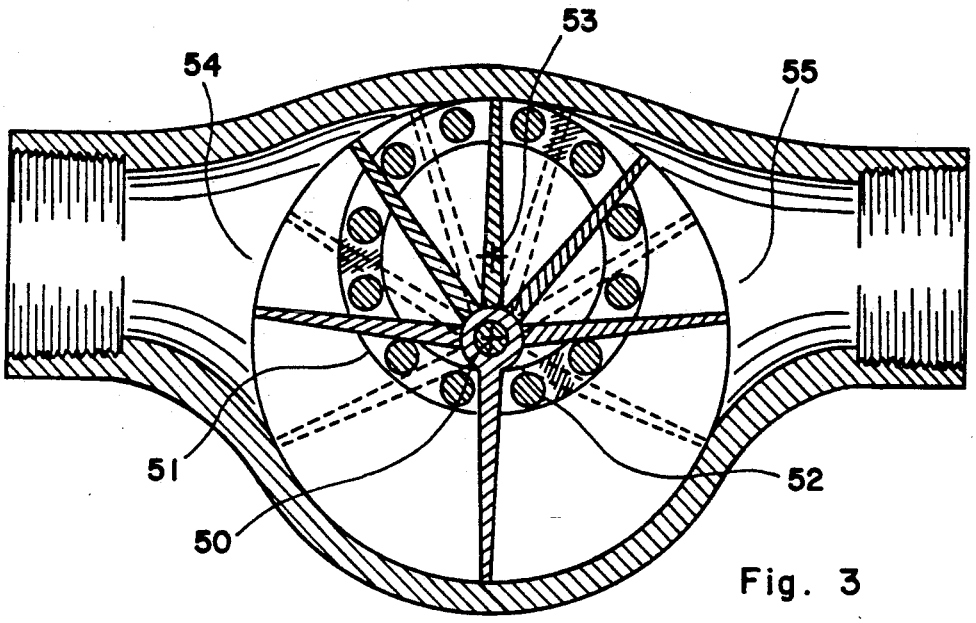
FIG. 3 illustrates a cross section of a further embodiment employing six flaps.

In FIG. 3 there is illustrated a cross section of a further embodiment of the present invention employing six flaps individually rotatable about the first axis of rotation 50. The flap spacer assembly 51 includes a plurality of rollers or spacers 52 uniformly distributed following a circular cylindrical surface coaxial to the second axis of rotation 53, wherein the plurality of spacings between the rollers or spacers 52 are alternatively used as the axial openings respectively engaged by the flaps, and the vent openings allowing the fluid media to move freely across the circular cylindrical boundary of the flap spacer assembly 51. The positions of the flaps shown in broken lines represent the positions of flaps, when the flap spacer assembly 51 is rotated over 30 degrees from the position thereof shown in solid lines, which rotated positions of the flaps show how the two port openings 54 and 55 are separated from one another by two unbroken portions of the circular cylindrical wall of the circular cylindrical cavity in the manner described in conjunction with FIG. 1. As a design alternative to the particular embodiment shown in FIG. 3, an embodiment employing twelve flaps can be constructed by adding an additional six blades respectively at locations shown in broken lines. In such a modified version of the embodiment shown in FIG. 3, it should be noticed that every spacing between the rollers or spacers 52 is engaged by the individual flap, and consequently, the separate vent openings included in the embodiments shown in FIGS. 1 and 2, and the original version of the embodiment shown in FIG. 3, are now omitted, and the gap between the individual flap and the two opposite edges of the spacing between two adjacent rollers or spacers 52 plays the role of the vent openings. It should be understood that the present invention may include any number of the flaps equal to or greater than three depending on the operating conditions and design preference.

In FIG. 4 there is illustrated a cross section of an embodiment of the present invention similar to that shown in FIG. 1, which illustrates an embodiment of the combination of the flap assembly and the flap spacer assembly. A plurality of flaps 56, 57, etc. are rotatably mounted on a shaft 58 concentric to the first axis of rotation 59 coinciding with the central axis of the circular cylindrical cavity 60 by means of a hub assembly resembling the piano-hinge construction, wherein the shaft 58 is rotatably supported by the apparatus body 61 at one extremity thereof by means of bearings in a cantilever-like disposition of the shaft 58. In an alternative design, the shaft 58 may be secured to the apparatus body 61 in a fixed nonrotatable arrangement. The flap spacer assembly comprises a plurality of rollers 62, 63, etc. distributed on a circular cylindrical surface coaxial to the second axis of rotation 64 coinciding with the central axis of the power shaft 65 and rotatably supported by the end plate 66 and the end ring 67 rotating with the power shaft 65 that is rotatably supported by the apparatus body 61 by means of bearings in the cantilever-like disposition of the power shaft 65. When the apparatus is used as a flowmeter, the power shaft 65 may be terminated within the apparatus body 61 and the seal 68 may be omitted, as there is no need for transmitting power from or to the combination of the flap assembly and the flap spacer assembly.

In FIG. 5 there is illustrated a cross section of an embodiment of the present invention similar to that shown in FIG. 2, which illustrates another embodiment of the combination of the flap assembly and the flap spacer assembly. A plurality of flaps 69, 70, etc. are mounted on the shaft 71 coaxial to the first axis of rotation 72 coinciding with the central axis of the circular cylindrical cavity by means of an assembly resembling the piano-hinge construction, wherein only one of the plurality of flaps is nonrotatably mounted on the shaft 71, while the remaining flaps are mounted rotatably on the shaft 71. As the shaft 71 is rotatably supported by the apparatus body 73 by bearings at both ends thereof, all of the flaps are allowed to rotate independently from each other. The flap spacer assembly comprises a plurality of rollers or spacers supported by two end flanges or end rings 74 and 75, which are supported by the apparatus, body 73 rotatably about the second axis of rotation 76 eccentric to the circular cylindrical cavity at both ends thereof by means of bearings. It should be noticed that, when the apparatus is used as a flowmeter, both ends of the shaft 71 may be terminated within the apparatus body 73 and a magnetic rotary motion coupling 77 may be employed to transmit the rotating motion of the combination of the flap assembly and the flap spacer assembly to an external shaft 78 connected to a mechanical rotary motion sensor or counter, that provides the information on the flow rate of the fluid media moving through the apparatus. When the magnetic rotary motion coupling 77 has a high torque capacity, the external shaft 78 can be used as a power shaft transmitting power from and to the combination of the flap assembly and the flap spacer assembly.

In FIG. 6 there is illustrated a cross section of an embodiment of the present invention similar to that shown in FIG. 3, which illustrates a further embodiment of the combination of the flap assembly and the flap spacer assembly. The shaft 79 supporting a plurality of flaps 80, 81, etc. rotatably about the first axis of rotation 82 coaxial to the circular cylindrical cavity 83 is supported by a pair of nonrotating rigid flanges 84 and 85 disposed coaxially to the second axis of rotation 86 eccentric to the circular cylindrical cavity 83, wherein the two rigid flanges 84 and 85 are nonrotatably supported by the apparatus body 87, as the two shafts 88 and 89 respectively extending from the two rigid flanges 84 and 85 in a coaxial relationship are affixed to the apparatus body 87 at the extremities thereof. The flap spacer assembly has a plurality of rollers or spacers 90, 91, etc. disposed on a circular cylindrical surface coaxial to the second axis of rotation 86 intermediate two flanges 92 and 93 disposed rotatably about the second axis of rotation 86 and supported by the apparatus body 87, as two hollow shafts 94 and 95 respectively extending from the two flanges 92 and 93 in a coaxial relationship are rotatably supported by the apparatus body 87 by bearings. It should be noticed that the nonrotating shafts 88 and 89 respectively extending from two rigid flanges 97 and 98 engage the central holes included in the two hollow shafts 94 and 95, respectively, and consequently, the entire flap spacer assembly can be freely rotated about the second axis of rotation 86. One of the two hollow shafts 94 and 95 extending through and out of an end wall of the circular cylindrical cavity 83 has a power transmitting device 96 such as a pulley or gear and plays the role of the power shaft in transmitting power from and to the combination of the flap assembly and the flap spacer assembly. When the apparatus is used as a flowmeter, the pulley or gear 96 should be omitted and both of the hollow shafts 94 and 95 should be terminated within the apparatus body 87. The shaft 79 supporting the flaps in a rotating relationship may be supported by the two rigid and fixed flanges 84 and 85 in a rotating relationship as shown in the particular illustrative embodiment by means of the bearings 97 and 98, or in a fixed nonrotatable relationship in an alternative design. The embodiment shown in FIG. 6 is most desirable, when an apparatus is of a large size and must handle a large volume flow of the fluid media.

Figure 7:
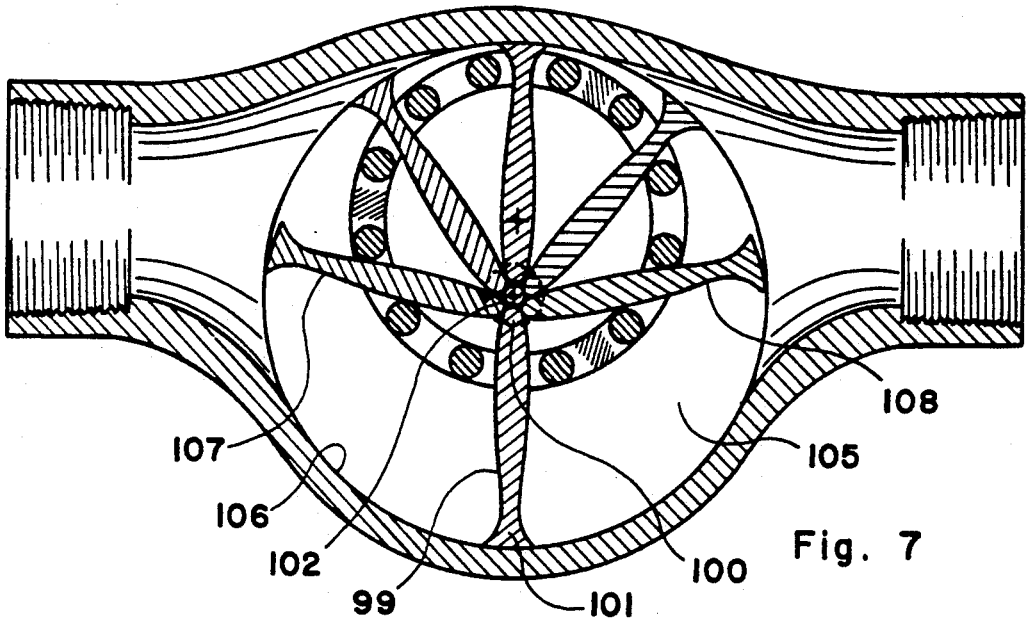
FIG. 7 illustrates a cross section of a modified version of the embodiment shown in FIG. 3.

In FIG. 7 there is illustrated a cross section of a modified version of the embodiment shown in FIGS. 3 and 6. The cross section of the individual flap 99 included in this modified version has a substantially semicircular or round inner radial edge 100 and an expanded outer radial edge 101. The flap assembly comprises a plurality of flaps disposed about the central circular cylindrical rod 102 in a radially extending pattern, wherein the substantially semicircular or round inner radial edges of the flaps are commonly tangential to the circular cylindrical surface of the central rod 102 and/or the substantially semicircular or round inner radial edges of every adjacent pair of flaps are tangential to one another, whereby the media is prevented from leaking from an apex region between one adjacent pair of flaps to an apex region between other adjacent pair of flaps through the gap between the circular cylindrical surface of the central rod 102 and the substantially semicircular or round inner radial edge of the individual flap and/or through the gap between the substantially semicircular or round inner edges of two adjacent flaps. Each of the plurality of flaps 99 is supported by a pair of fixed flanges 103 and 104 shown in FIG. 8 in a relationship allowing pivoting movement of the flap about the central axis of radius of the substantially semicircular or round inner radial edge 100 of the flap, while the flap assembly is also supported by the two fixed flanges 103 and 104 rotatably about the first axis of rotation coinciding with the central axis of the central rod 102, that is coaxiall to the circular cylindrical cavity 105. The outer radial edge 101 of the individual flap 99,,that has an expanded terminus, provides a close tolerance relationship between the terminus of the flap and the circular cylindrical wall 106 of the circular cylindrical cavity 105 during all phases of rotation of the flap assembly about the first axis of rotation as exemplified by the flaps rotated to the positions 107 and 108.

Figure 8:
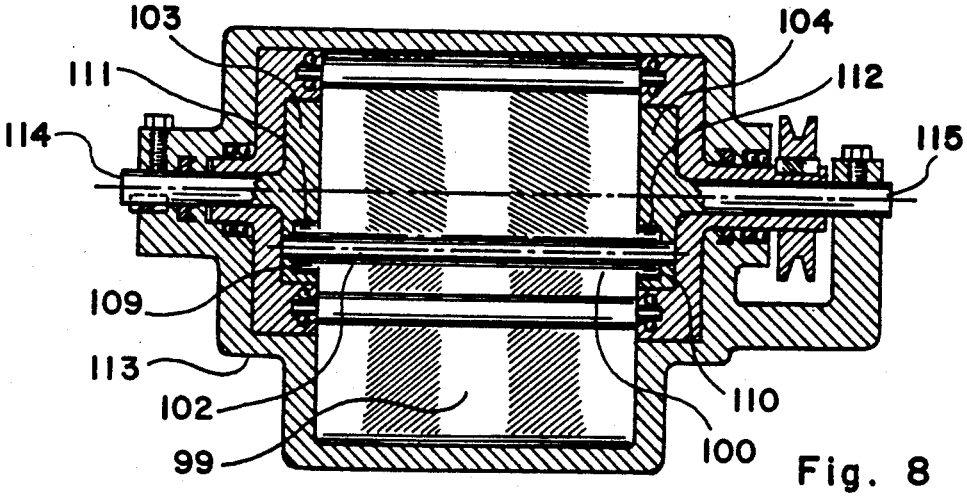
FIG. 8 illustrates another cross section of the modified version of the embodiment shown in FIG. 7.

In FIG. 8 there is illustrated another cross section of the modified version shown in FIG. 7, which cross section is taken along a plane including the first and second axis of rotation. The individual flap 99 has two stub shafts or posts 109 and 110 respectively extending from the two opposite ends of the flap 99 in a relationship coaxial to the central axis of radius of the substantially semicircular or round inner radial edge 100 of the flap, each of, which two stub shafts or posts, 109 and 110 engages the annular grove intermediate the counter bore 111 included in the fixed flange 103 and the central rod 102 or the annular grove intermediate the counter bore 112 included in the fixed flange 104 and the central rod 102. It should be noticed that the two fixed flanges 103 and 104 are affixed to the apparatus body 113, as two shafts 114 and 115 respectively extending from the two fixed flanges 103 and 104 are nonrotatably secured to the apparatus body 113. The rotating motion of the flap assembly about the first axis of rotation coaxial to the central rod 102 is facilitated by the two sets of the stub shafts or posts respectively distributed about the central rod 102 in an arrangement resembling the roller bearing in engaging two counter bores 111 and 112, respectively. It is readily recognized that each of the two sets of the stub shafts or posts and the central rod 102 may engage a bore of a ball or roller bearing fitted into each of the two counter bores 111 and 112 respectively included in the two fixed flanges 103 and 104, which arrangement drastically enhances the frictionless rotating motion of the flap assembly about the first axis of rotation coinciding with the central axis of the central rod 102. The flap spacer assembly employed in this modified version has the same structure and operates on the same principles as those described in conjunction with FIG. 6. It should be understood that the modified embodiment of the flap assembly shown and described in conjunction with FIGS. 7 and 8 can also be incorporated into the embodiment shown in FIG. 4 or 5.

While the principles of the present invention have now been made clear by the illustrative embodiments, there will be many modifications of the structures, arrangements, proportions, elements and materials, which are immediately obvious to those skilled in the art and particularly adapted to the specific working environments and operating conditions in the practice of the invention without departing from those principles. It is not desired to limit the invention to the particular illustrative embodiments shown and described, and accordingly, all suitable modifications and equivalents may be regarded as falling within the scope of the invention as defined by the claims which follow.

The embodiments of the invention, in which an exclusive property or privilege is claimed, are defined as follows:

We claim:

1. An apparatus for executing a function related to flow of media comprising in combination:

a) a body of apparatus including a cylindrical cavity with a cylindrical wall substantially coinciding with a first circular cylindrical surface and two closed ends, and two port openings respectively open to two opposite halves of the cylindrical cavity respectively located on two opposite sides of a plane including the central axis of the cylindrical cavity;

b) a flap assembly including a plurality of flaps disposed within the cylindrical cavity about a first axis of rotation concentric to the first circular cylindrical surface in a radiating pattern and supported by at least one supporting member in a relationship allowing rotating movement of the flap assembly about the first axis of rotation and independent pivoting movement of each of the plurality of flaps about the first axis of rotation; wherein outer radial edges of the flaps slide on the cylindrical wall of the cylindrical cavity and two opposite end edges of the flaps respectively slide on two opposite end walls of the cylindrical cavity during rotating movement of the flap assembly about the first axis of rotation, and inner radial edges of the flaps are assembled in a radially converging relationship limiting leakage of the media from an apex region between one adjacent pair of the flaps to other apex regions between other adjacent pairs of the flaps through crevices between the inner radial edges of the flaps;

c) a flap spacer assembly including a plurality of spacers disposed within the cylindrical cavity following a second circular cylindrical surface concentric to a second axis of rotation and eccentric to the first axis of rotation, and supported by a least one supporting member in a relationship allowing rotating movement of the flap spacer assembly about the second axis of rotation; wherein the plurality of spacers provide a plurality of axial openings respectively disposed between adjacent pairs of the spacers, and each of the plurality of flaps engages and extends through each of the plurality of axial openings in a substantially free-sliding relationship; and d) a plurality of vent openings included in the flap spacer assembly respectively providing at least one media passage across cylindrical boundary of the flap spacer assembly for each compartment intermediate each adjacent pair of the flaps, whereby the media confined in said each compartment are allowed to move freely across the cylindrical boundary of the flap spacer assembly.

2. An apparatus as defined in claim 1 wherein said combination includes means for measuring rotary speed of the combination of the flap assembly and the flap spacer assembly as a measure of flow rate of the media moving through the apparatus.

3. An apparatus as defined in claim 1 wherein said combination includes means for transmitting power from and to rotary motion of the combination of the flap assembly and the flap spacer assembly.

4. An apparatus as defined in claim 1 wherein each of the plurality of axial openings engaged by each of the plurality of flaps has two opposite edges respectively provided by two elongated cylindrical rollers.

5. An apparatus as defined in claim 1 wherein the two port openings respectively open to the two opposite halves of the cylindrical cavity are separated from one another on one circumferential side of the cylindrical cavity by an unbroken portion of the cylindrical wall of the cylindrical cavity extending over an angle about the first axis of rotation at least substantially equal to a maximum angle between adjacent pair of the flaps occuring during rotation of the flap assembly about the first axis of rotation, and on the other circumferential side of the cylindrical cavity diametrically opposite to said one circumferential side by another unbroken portion of the cylindrical wall of the cylindrical cavity extending over an angle about the first axis of rotation at least substantially equal to a minimum angle between adjacent pair of the flaps occuring during rotation of the flap assembly about the first axis of rotation.

6. An apparatus as defined in claim 1 wherein the plurality of spacers included in the flap spacer assembly comprise a plurality of elongated cylindrical rollers disposed parallel to and about the second axis of rotation in a spaced-apart relationship; wherein a first alternating combination of spaces between the elongated cylindrical rollers constitute the axial openings respectively engaged by the flaps, and a second alternating combination of spaces between the elongated cylindrical rollers constitute the vent openings providing the media passage across the cylindrical boundary of the flap spacer assembly.

7. An apparatus as defined in claim 6 wherein said combination includes means for measuring rotary speed of the combination of the flap assembly and the flap spacer assembly as a measure of flow rate of the media moving through the apparatus.

8. An apparatus as defined in claim 6 wherein said combination includes means for transmitting power from and to rotary motion of the combination of the flap assembly and the flap spacer assembly.

9. An apparatus as defined in claim 6 wherein the two port openings respectively open to the two opposite halves of the cylindrical cavity are separated from one another on one circumferential side of the cylindrical cavity by an unbroken portion of the cylindrical wall of the cylindrical cavity extending over an angle about the first axis of rotation at least substantially equal to a maximum angle between adjacent pair of the flaps occuring during rotation of the flap assembly about the first axis of rotation, and on the other circumferential side of the cylindrical cavity diametrically opposite to said one circumferential side by another unbroken portion of the cylindrical wall of the cylindrical cavity extending over an angle about the first axis of rotation at least substantially equal to a minimum angle between adjacent pair of the flaps occuring during rotation of the flap assembly about the first axis of rotation.

10. An apparatus as defined in claim 1 wherein each of the plurality of spacers included in the flap spacer assembly has at least one vent opening disposed intermediate two opposite edges of the spacer respectively guiding an adjacent pair of the plurality of flaps.

11. An apparatus as defined in claim 10 wherein said combination includes means for measuring rotary speed of the combination of the flap assembly and the flap spacer assembly as a measure of flow rate of the media moving through the apparatus.

12. An apparatus as defined in claim 10 wherein said combination includes means for transmitting power from and to rotary motion of the combination of the flap assembly and the flap spacer assembly.

13. An apparatus as defined in claim 10 wherein each of the plurality of spacers included in the flap spacer assembly has two elongated cylindrical rollers respectively included in the two opposite edges of the spacer respectively guiding an adjacent pair of the plurality of flaps.

14. An apparatus as defined in claim 10 wherein the two port openings respectively open to the two opposite halves of the cylindrical cavity are separated from one another on one circumferential side of the cylindrical cavity by an unbroken portion of the cylindrical wall of the cylindrical cavity extending over an angle about the first axis of rotation at least substantially equal to a maximum angle between adjacent pair of the flaps occuring during rotation of the flap assembly about the first axis of rotation, and on the other circumferential side of the cylindrical cavity diametrically opposite to said one circumferential side by another unbroken portion of the cylindrical wall of the cylindrical cavity extending over an angel about the first axis of rotation at least substantially equal to a minimum angle between adjacent pair of the flaps occuring during rotation of the flap assembly about the first axis of rotation.

15. An apparatus as defined in claim 1 wherein the plurality of spacers included in the flap spacer assembly comprise a plurality of elongated members disposed parallel to and about the second axis of rotation in a spaced-apart relationship; wherein each of plurality of spaces between the elongated members is engaged by each of the plurality of flaps in a clearance relationship providing a substantial gap between the flap and two opposite edges of the space between adjacent pair of the plurality of elongated members, whereby the media is allowed to move freely across the cylindrical boundary of the flap spacer assembly through said gap.

16. An apparatus as defined in claim 15 wherein said combination includes means for measuring rotary speed of the combination of the flap assembly and the flap spacer assembly as a measure of flow rate of the media moving through the apparatus.

17. An apparatus as defined in claim 15 wherein said combination includes means for transmitting power from and to rotary motion of the combination of the flap assembly and the flap spacer assembly.

18. An apparatus as defined in claim 15 wherein the two opposite edges of each of the plurality of spaces between the plurality of elongated members respectively include two elongated cylindrical rollers respectively guiding an adjacent pair of the plurality of flaps.

19. An apparatus as defined in claim 15 wherein the two port openings respectively open to the two opposite halves of the cylindrical cavity are separated from one another on one circumferential side of the cylindrical cavity by an unbroken portion of the cylindrical wall of the cylindrical cavity extending over an angle about the first axis of rotation at least substantially equal to a maximum angle between adjacent pair of the flaps occuring during rotation of the flap assembly about the first axis of rotation, and on the other circumferential side of the cylindrical cavity diametrically opposite to said one circumferential side by another unbroken portion of the cylindrical wall of the cylindrical cavity extending over an angle about the first axis of rotation at least substantially equal to a minimum angle between adjacent pair of the flaps occuring during rotation of the flap assembly about the first axis of rotation.

* * * * *